US005318092A

United States Patent [19]

Andrews

[11] Patent Number: 5,318,092

[45] Date of Patent: Jun. 7, 1994

[54] METHOD FOR CONTROLLING THE COLLAPSIBILITY OF FOUNDRY MOLDS AND CORES

[76] Inventor: Robert S. L. Andrews, 7712 Incline Ter., Fort Worth, Tex. 76179

[21] Appl. No.: 943,051

[22] Filed: Sep. 10, 1992

[51] Int. Cl.[5] ..... B22C 3/00

[52] U.S. Cl. ..... 164/14; 164/526

[58] Field of Search ..... 164/6, 14, 525, 526

[56] References Cited

U.S. PATENT DOCUMENTS

| | | | |
|---|---|---|---|
| 3,121,269 | 2/1964 | Lansing, III | 164/14 |
| 4,113,510 | 9/1978 | Richard | 164/5 |
| 4,248,974 | 2/1981 | Fujii | 164/521 |

FOREIGN PATENT DOCUMENTS

| | | | |
|---|---|---|---|
| 57-160551 | 10/1982 | Japan | 164/14 |

*Primary Examiner*—Kurt C. Rowan
*Assistant Examiner*—Rex E. Pelto
*Attorney, Agent, or Firm*—Charles D. Gunter, Jr.

[57] ABSTRACT

A method and apparatus are shown for improving the collapsibility characteristics of foundry cores and molds after being contacted with a heated, cast product. The foundry cores/molds are contacted with an oxidant impregnating liquid after being formed and prior to contact with the heated, cast product. The heat of the cast product is sufficient to sustain combustion of the chemical coating of the sand particles making up the cores/molds to facilitate removal with a minimum of force after casting.

6 Claims, 3 Drawing Sheets

METHOD FOR CONTROLLING THE COLLAPSIBILITY OF FOUNDRY MOLDS AND CORES

BACKGROUND OF THE INVENTION

1. Field of the Invention

The present invention relates generally to foundry sand of the type used to make core molds into which non-ferrous metals are cast and, more specifically, to a foundry sand and method for providing cores and molds having significantly improved shake-out and collapsibility characteristics.

2. Description of the Prior Art

Foundry sand is commonly used to make core and molds into which ferrous and non-ferrous metals are cast. The core/molds consist of sand bonded with special additives, including inorganic binders such as clay and organic or "resin" binders, such as phenol, melamine or urea formaldehyde. The term "chemically bonded cores" is intended in the context of the present discussion to encompass both organic and resin bonded foundry sands of the type described above.

One known process for making metal castings employing resin bonded sands is the "shell process." In this process, a core or mold is formed in the desired configuration from the resin-coated sand and a metal is then poured around the shell cores. The resin system slowly burns out, removing the resin binder from the system. If the system works satisfactorily, the core collapses.

An example of a previously known resin binder used in the shell process is a phenolic novolak resin cured with hexamethylene tetramine. These particular resin binders have obtained widespread acceptance because of resulting high tensile strengths, with the result being the formation of very strong cores. One disadvantage of the use of such resin binders occurs as a result of the incomplete decomposition of the resin binder during the casting process. If the resin binder burns out more or less completely or decomposes, the core which remains consists essentially of sand and becomes free flowing and can be readily removed from the casting. On the other hand, if the chemically bonded sand does not degrade to a sufficient extent, the core or portions thereof remain inside the casting and can generally only be removed by mechanical means. The result is that in some applications, such as engine blocks and heads, it is virtually impossible to remove pieces of the core which have not been completely burned out and collapsed.

One particular problem with the prior art resin binders concerns the manufacture of aluminum alloy casting of the type used in automobile engine manufacture. Iron and steel are generally poured at temperatures in the range from about 2200° to 3000° F. At those temperatures, burnout of the chemically bonded sands is usually complete. However, aluminum, brass, bronze and other metals and alloys have lower melting points and are poured at temperatures on the order of 1200° to 2000° F. These lower temperatures present the possibility of additional problems with shake out and collapsibility of the core. At such lower temperatures, resin bonded sands, in particular, do not burn out completely resulting in cores or portions of cores being left within the castings.

Prior methods used in attempting to remove organic bonded foundry cores by mechanical means, such as attrition during airless blast machine cleaning of the castings, vibrating the castings through their natural frequency range to disintegrate the core remaining in the internal cavities or manually using pneumatic impact tools, have only been economically successful in certain instances. The core removal stage of casting cleaning still remains a major cost factor in the manufacture of cast products. Particularly aluminum alloy castings manufactured in so-called semi-permanent molds, consisting of a metal or graphite mold into which resin bonded cores are set.

In order to facilitate removal of cores by any of the aforementioned methods, the principal breakdown or collapsibility control of foundry cores has been to adjust the proportions of the ingredients in the mix from which the cores are made. For instance, in conventional baked oil sand cores, the amount of binder oil and combustible material such as wood flour or cereal are varied as well as the baking time. A decrease in the amount of binder oil and an increase in the amount of wood flour, lowers the temperature at which the cores breakdown after the molten metal has been poured. It also lowers the tensile strength of the core and may result in mechanical failure of the cores under metallic static head pressure at the beginning of the molten metal pour.

Collapsibility of resin bonded cores can only be adjusted by increasing or decreasing the binder resin and catalyst within narrow limits because these components of the mix also control the core making process in terms of "working time" and "stripping time" in the case of cold curing systems. Gas cured systems demand critical control of both resin binder and gassing time in order to maintain physical properties within consistent narrow limits. Hot cured systems are based on a "time-temperature" function that is related to the type of resin such as phenolic, urea, a blend of the two resins, or a urethane. They are all thermosetting therefore, curing temperature is critical.

As the need to reduce the weight of automobiles in order to meet the mileage standards of the Federal Rules and Regulations becomes more urgent in the late nineties, the foundry industry is converting more and more production capacity to semi-permanent molding of thin-walled aluminum alloy castings, particularly ceramic powder reinforced aluminum and magnesium super alloys.

This trend has intensified the problem of core breakdown or collapsibility due to the reduced mass of the cast metal available for burning the organic binders in the cores to a weak "carbon bond" to facilitate removal during the casting cleaning stage. If the cores retain a high percentage of their original cured tensile strength, removal by any mechanical means results in casting distortion, breakage or disintegration and uneconomical labor costs.

One object of the present invention is to provide a method for reducing the physical strength of the residual chemical binder in a mold or core to a weak carbon bond between the sand grains by means of self-sustained oxidation, after the molten metal has been poured.

Another object of the invention is to ensure uniform collapsibility of the mold or core during the elapsed time of pouring the molten metal and shake-out or ejection from a permanent mold or die.

A further object of the invention is to control the rate of collapsibility of the mold or core without affecting its specified physical properties, prior to the start of the molten metal pouring stage.

A further object of the invention is to control the rate of collapsibility of the mold or core without affecting its specified permeability in terms of volume and rate of gas evolution during the molten metal pouring and cooling stages.

Another object of the invention is to control the rate and uniformity of collapsibility of the mold or core to enable the casting cleaning stage to be automated.

SUMMARY OF THE INVENTION

The method of the present invention is used to produce chemically bonded foundry molds or cores which are more easily removed from non-ferrous castings. A previously formed mold or core is impregnated with an oxidant impregnating liquid formulated with an oxidant material which is ignitable by the heat of a cast product metal. The addition of the oxidant material to the mold or core serves to sustain combustion of the chemical binders used to initially form the mold or core so as to reduce such binders to a weak carbon bond which permits the mold or core to be removed with minimum effort.

A suitable oxidant material can be selected from the group consisting of potassium chlorate, sodium nitrate and potassium nitrate.

A suitable apparatus for practicing the invention includes a reservoir tank for melting the oxidant materials into a viscous liquid. The liquid is then pumped to an impregnating tank having an interior which is initially evacuated by a vacuum pump and whose temperature is controlled by a heater. The core/molds are located within the impregnating tank on a grating and are contacted with the viscous liquid for a predetermined dwell time. After a pre-set elapsed time, the excess impregnating oxidant liquid is withdrawn from the impregnating tank as atmospheric air is simultaneously admitted to the impregnating tank. The core/molds which have been impregnated with the solidified colloidal liquid can be removed from the apparatus.

Additional objects, features and advantages will be apparent in the written description which follows.

DETAILED DESCRIPTION OF THE INVENTION

Foundry cores and/or molds are typically formed by first contacting a hot pattern with free flowing particles of a chemically coated sand, the particles being coated with a chemical binder. The particles of chemically coated sand are maintained against the hot pattern to bond a portion of the particles of chemically coated sand together to form a foundry mold or core. The foundry mold or core is then cured at an elevated temperature to form a dimensionally stable mold or core. The dimensionally stable foundry mold or core is then removed from the pattern and used in a subsequent casting operation.

In the method of the present invention, a mechanism is provided for reducing the physical properties of such chemically bonded molds and cores in order to control the collapsibility of such molds/cores. In order to accomplish this objective, the inventive method purposefully achieves sustained oxidation of the resinous binder between the sand grains in the mold/core to promote a weak carbon bond after the cast metal has solidified to form the product casting. A "weak carbon bond" is intended to describe a state of collapsibility of the sand grains making up the mold/core promoted by the addition of an oxidant material in which the mold/core collapses naturally with a minimum of effort and without the need for external vibrators, pneumatic impact tools, or the like. The inventive method thus facilitates subsequent shake-out and ejection of a cast part from a permanent mold or die.

Figure 1:
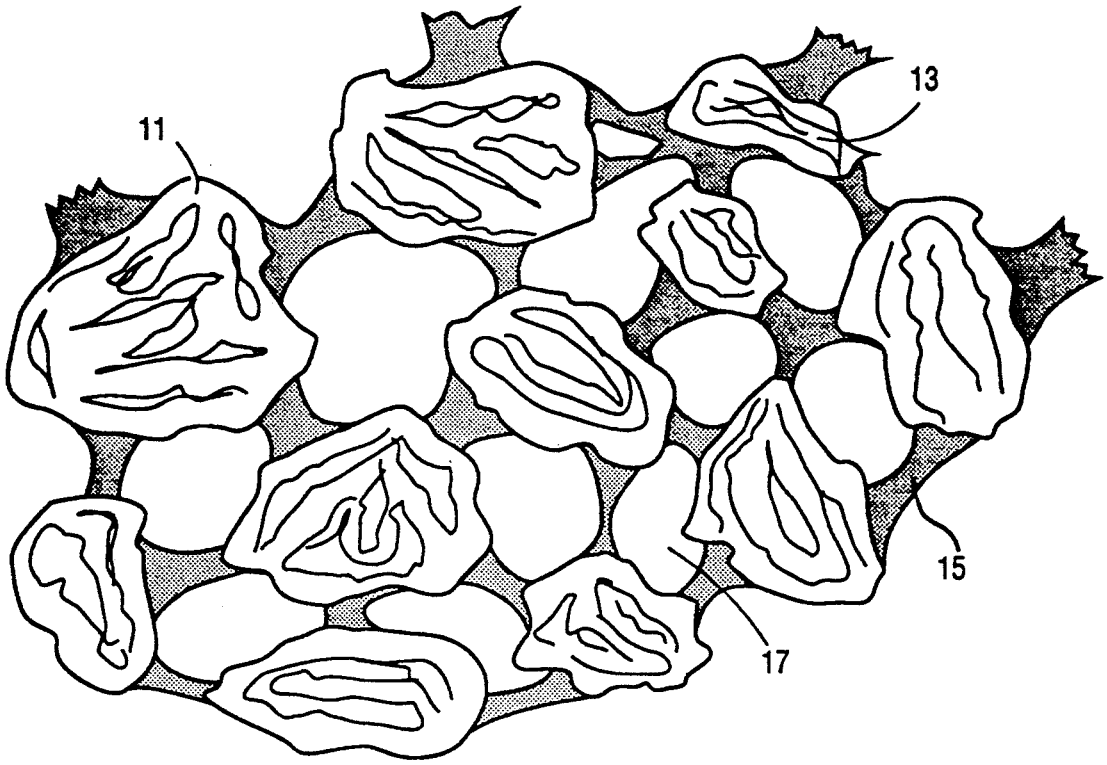
FIG. 1 is a simplified, schematic view of a chemically bonded mold or core showing the capillary resin links between the sand grains.

Microscopic examination of the internal structure of chemically bonded molds and cores reveals that the sand grains are held together by "capillary" links of cured resin binder. FIG. 1 is a simplified schematic illustrating the internal structure of such a chemically bonded mold or core. All the sand grains, both coarse 11 and fine 13 are linked together by capillary links of cured resin binder 15. The inter-granular space 17 remaining between the sand grains determines the permeability or "porosity" of the mold or core structure.

The conventional means in the industry for adjusting the permeability is by increasing the American Foundrymen's Society (AFS) Fineness Number to decrease it, or decreasing the AFS Fineness Number to increase the permeability of the mold or core. The overall adjustment of permeability is subject to three practical limiting factors: (1) poor surface finish on the product casting due to the average sand grain being too coarse; (2) gas defects in the product casting due to the average sand grain being too fine; and (3) the percentage of resin binder in the mold or core exceeding the economic limit.

Figure 2:
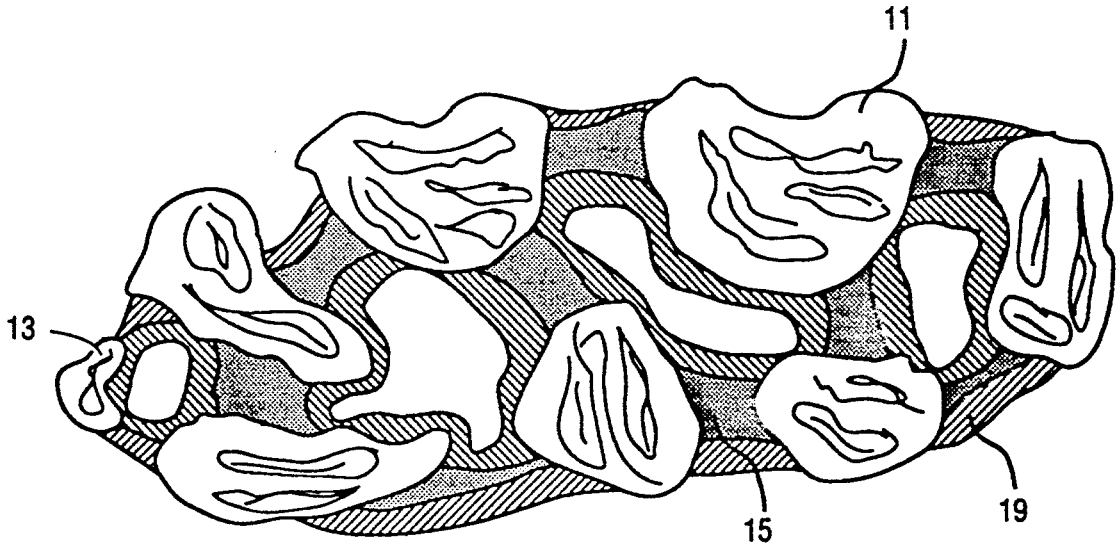
FIG. 2 is a view similar to FIG. 1 showing the capillary resin links coated with oxidizing agents.

The method of the present invention coats or impregnates the resin links of the previously cured sand grains in a mold or core with an oxidant material. To provide inter-granular space for coating the capillary links of cured resin binder between the sand grains of a mold or core, the specified permeability for a mold or core must be increased by an average of three to five AFS Fineness Numbers. This is well within the range of permeability limitations. FIG. 2 is a simplified schematic similar to FIG. 1 and illustrates how the method of the present invention is used to coat the resin links with certain oxidizing chemicals 19 contained within an oxidant impregnating liquid. The oxidant impregnating liquid is forced into the inter-granular space under negative pressure using a suitable apparatus (presently to be described) with the excess liquid being withdrawn under positive atmospheric pressure back into a reservoir tank.

Figure 3:
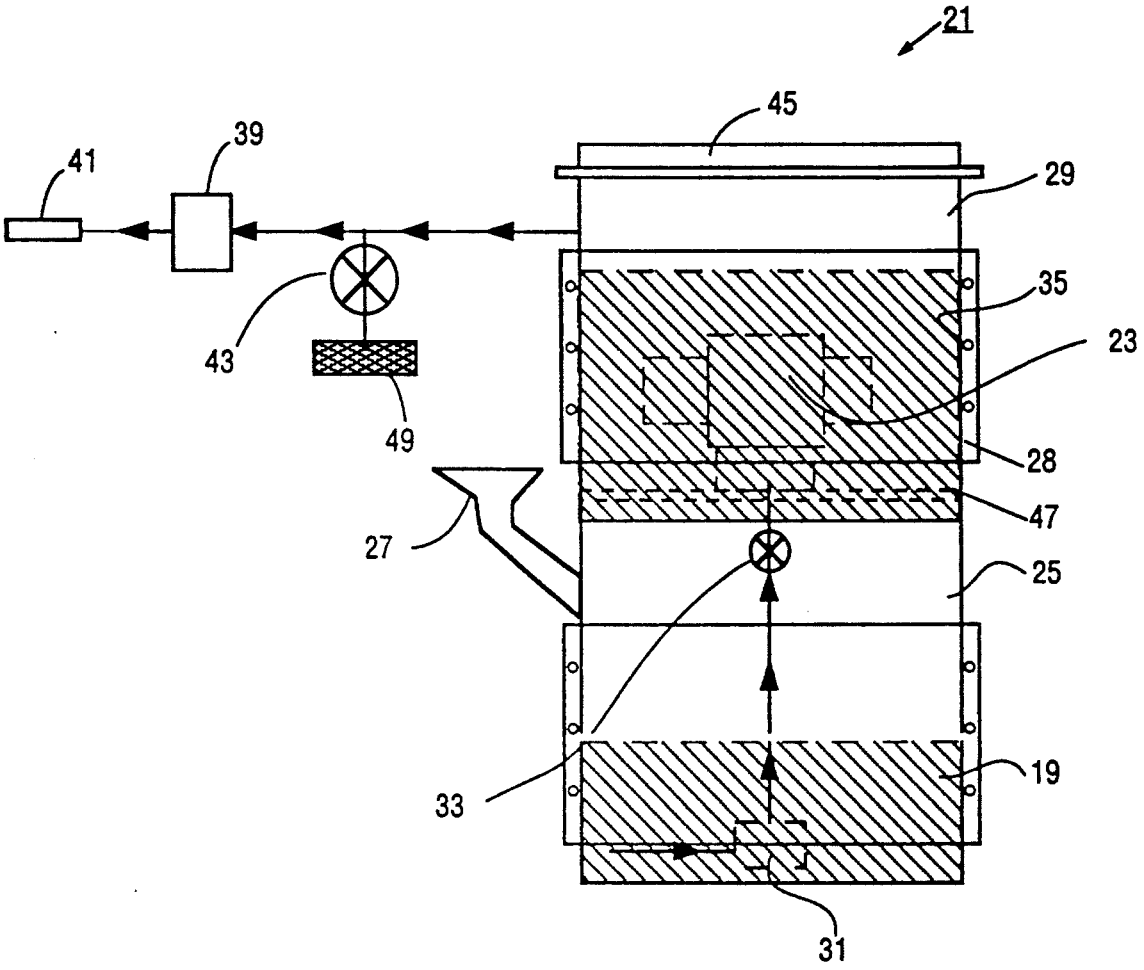
FIG. 3 illustrates one form of an apparatus useful in practicing the method of the invention, the apparatus being operated under negative pressure, impregnating chemically bonded molds or cores.
Figure 4:
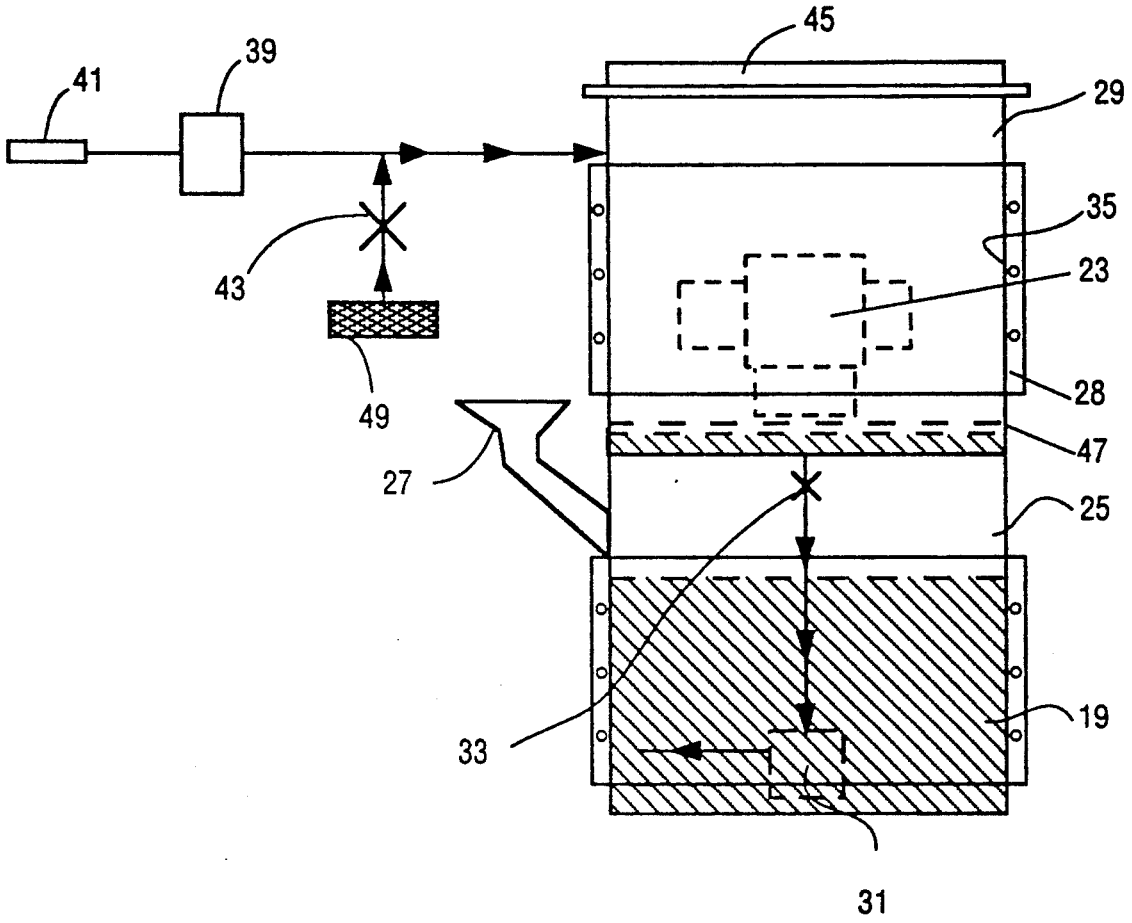
FIG. 4 is a similar view of the apparatus of FIG. 3 showing the step of returning oxidant liquid to the reservoir tank, the apparatus being under positive atmospheric pressure.

A preferred type of apparatus for coating the cured resin links between the sand grains of chemically bonded molds and cores is illustrated in simplified fashion in FIGS. 3 and 4. The apparatus, designated generally as 21 in FIG. 3, meets the essential requirements for controlling the uniformity and thickness of an oxidant impregnating liquid 19 which is deposited on the capillary resin links between the sand grains throughout a previously cured mold or core's section thickness (23 in FIG. 3).

The preferred apparatus 21 which is shown in FIG. 3 consists of a reservoir tank 25 with a vented covered access port 27 for loading and topping up the oxidant materials. At a controlled temperature, the oxidant materials melt and blend into a viscous liquid (shown as 19 in FIG. 3) that is pumped into an impregnating tank 29 by a reversible, positive displacement pump 31 through an open, normally closed, blocking control valve 33. The impregnating tank 29 has an interior 35 whose temperature is controlled by a heater 28. The interior 35 of the tank 29 is evacuated by a vacuum pump 39 to the atmosphere through a silencer 41 with a normally closed three-way control valve (shown as 43 in FIG. 3) in the closed position.

Access to the impregnating tank 29 is by means of a vacuum sealable top cover 45. There is a grating 47 at the bottom of the impregnating tank 29 on which the molds or cores 23 are stacked for impregnating with the oxidant impregnating liquid 19.

After a pre-set elapsed time, the excess oxidant impregnating liquid 19 which has been drawn into the interior 35 of the impregnating tank 29 is withdrawn from the impregnating tank 29. This is accomplished (see FIG. 4) by reversing the positive displacement pump 31 back into the reservoir tank 25 at the same time as atmospheric air is admitted to the impregnating tank 29 by opening the three-way control valve 43, the air being admitted through the air filter 49. After opening the top cover 45 of the impregnating tank 29 the mold or core 23 impregnated with the solidified colloidal liquid containing the oxidant material can be removed from the apparatus 21. The previously described sequence of operation is repeated on the basis of production batches.

The means for heating the content of the reservoir tank 25 may be either an electrical or a natural gas heater 26 and for the impregnating tank 29 the heating means may be either an electrical or steam heater 28. By adjustment and control of the oxidant impregnating liquid temperature, its viscosity may be matched to the intergranular space 17 of the mold or core's specification for permeability limits. The thickness of the oxidant coating 19 on the capillary links of cured resin binder is controlled by a pre-set dwell time that the oxidant impregnating liquid 19 is allowed to remain in the impregnating tank 29 under negative pressure before being withdrawn back into the reservoir tank 25 under positive atmospheric pressure.

The weight of oxidant impregnating liquid deposited on the capillary resin links between the sand grains is equal to a minimum of 1.5 percent and a maximum of 2.5 percent of the total weight of the mold or core in the preferred method of the invention.

The oxidant impregnating liquid 19 (FIG. 3) which is used in practicing the method of the invention can be formulated by first forming a colloidal suspension to which is added a suitable oxidizing material. For example, the oxidant impregnating liquid 19 may be formulated by melting a wax like material such as bees wax, carnauba wax or clarified paraffin wax and holding it at a temperature of approximately 150°-300° F. while adding bentonite clay at a preferred ratio of one part by weight of clay to fifteen parts by weight of wax. After the bentonite clay has absorbed the liquid wax, a suitable oxidizing material is added with the result being a homogeneous liquid mass. The following oxidizing materials have been found to be acceptable for purpose of the present invention and may be added at a ratio of about two parts by weight of the colloidal suspension:

Potassium Chlorate ($KClO_3$)
Sodium Nitrate ($NaNO_3$)
Potassium Nitrate ($KNO_3$)

The preferred oxidant materials, such as those listed above, are ignitable at a temperature above about 500°-600° F.

For example, an oxidant impregnating liquid for impregnating chemically bonded molds or cores is formulated by adding potassium chlorate ($KClO_3$) and wood flour, ($C_6H_{10}O_5$), to a colloidal suspension of bentonite and paraffin wax heated to a temperature range 150 to 300° F. (65° to 147° C.) and controlled within this temperature range throughout the operating sequence for impregnating molds and cores.

The following examples are intended to be illustrative of the formulations of oxidant impregnating liquid useful in the practice of the present invention, without being otherwise limiting:

PERCENTAGE RANGE OF INGREDIENTS IN OXIDIZING FORMULATIONS
(Based on 100 lbs of oxidant impregnating liquid).

| INGREDIENT | FINENESS | WEIGHT | PERCENT |
|---|---|---|---|
| | EXAMPLE I | | |
| Melted Paraffin Wax | Liquid | 81.5 to 80.0 lbs | 81.5 to 80.0% |
| Bentonite Clay | +350 Mesh | 4.5 to 5.0 lbs | 4.5 to 5.0% |
| Wood Flour | +350 Mesh | 1.5 to 2.0 lbs | 1.5 to 2.0% |
| Potassium Chlorate | 300-350 Mesh | 12.5 to 13.0 lbs | 12.5 to 13.0% |
| | EXAMPLE II | | |
| Melted Paraffin Wax | Liquid | 78.5 to 76.0 lbs | 78.5 to 76% |
| Bentonite Clay | +350 Mesh | 3.5 to 5.0 lbs | 3.5 to 5.0% |
| Wood Flour | +350 Mesh | — | — |
| Sodium Nitrate | 300-350 Mesh | 18.0 to 19.0 lbs | 18.0 to 19.0% |
| | EXAMPLE III | | |
| Melted Paraffin Wax | Liquid | 81.5 to 79.5 lbs | 81.5 to 79.5% |
| Bentonite Clay | +350 Mesh | 2.5 to 3.0 lbs | 2.5 to 3.0% |
| Wood Flour | +350 Mesh | 1.0 to 1.5 lbs | 1.0 to 1.5% |
| Potassium Nitrate | 300-350 Mesh | 15.0 to 16.0 lbs | 15.0 to 16.0% |

Each of the above formulations adds 1.5 to 2 percent by weight to a chemically bonded sand mold or core after impregnation in the vacuum-liquid autoclave apparatus 21 previously described for a 5 to 10 second dwell time.

As previously mentioned, the viscosity of the oxidant impregnating liquid can be controlled by adjusting and controlling the temperature of the liquid within the impregnating tank 29. In this way, the viscosity of the oxidant impregnating liquid can be matched to the intergrannular space (17 in FIG. 1) of the core/mold's specification for the previously described permeability limits.

The mixture of melted clarified waxes and bentonite clays are preferably held at a temperature in the range from about 150°-300° F. during formulation of the oxidant impregnating liquid. The viscosity of the oxidant material or materials and colloidal suspension of liquid waxes and clays forming the oxidant impregnating liquid is preferably maintained within the range of 48° Baume-55° Baume (1.4948 to 1.6111 specific gravity).

The particular dwell time of the cores/molds within the interior 35 of the impregnating tank 29 is selected based upon the specified permeability of the chemically bonded mold/core which is to be impregnated with a predetermined weight of the oxidant impregnating liquid. The specified permeability is determined by applicable industry standards which will be familiar to those skilled in the art.

The aforegoing description of the present invention is directed primarily to the economical removal of chemically bonded cores from metallic or graphite permanent molds. By so doing, it is in no way intended to limit the scope of the present invention to the economical removal of chemical bonded cores from permanent molds because it is obvious the method is applicable to the manufacture of other types of hollow, non-ferrous cast products produced by other conventional molding methods.

While the invention has been shown in only one of its forms, it is not thus limited but is susceptible to various changes and modifications without departing from the spirit thereof.

What is claimed is:

1. A method for forming foundry cores and molds having improved collapsibility characteristics after being contacted with a heated, cast product, the method comprising the steps of:

contacting a hot pattern with free flowing particles of a chemically coated sand which are coated with a chemical binder;

maintaining the particles of chemically coated sand against the hot pattern to bond a portion of the particles of chemically coated sand together to form a foundry mold or core;

curing the foundry mold or core at an elevated temperature to form a dimensionally stable mold or core;

removing the dimensionally stable foundry mold or core from the pattern;

formulating an oxidant impregnating liquid containing an oxidant material by mechanically mixing the oxidant material on a percentage weight basis into a colloidal suspension consisting of melted clarified waves and bentonite clays held at a temperature in the range of 150°-300° F. in order to form a homogeneous liquid mass, wherein the oxidant material is ignitable at a temperature above about 600° F. and the oxidant material is selected from the group consisting of potassium chlorate, sodium nitrate and potassium nitrate; and thereafter, impregnating the cured and dimensionally stable foundry mold or core with the oxidant impregnating liquid present in an amount effective to be ignited by the heat of the cast product in a subsequent casting operation to sustain combustion of the chemical coating of the sand particles to thereby facilitate removal of the mold or core with a minimum of force after casting.

2. A method of claim 1, wherein the viscosity of oxidant materials and colloidal suspension of liquid waxes and clays forming the oxidant impregnating liquid is maintained within the range of 48° Baume and 55° Baume.

3. A method of claim 2, wherein the oxidant impregnating liquid which is used to impregnate the cured and dimensionally stable foundry mold or core is held in contact with the mold or core for a dwell time which is selected relative to the specified permeability of the chemically bonded mold or core to be impregnated with a pre-determined weight of the impregnating liquid.

4. A method of claim 3, wherein the pre-determined weight of the oxidant impregnating liquid which is deposited is capable, on heating, of supplying an amount of elemental oxygen required within the mold or core to sustain combustion of the chemical binder holding the particles of sand together, thereby reducing the chemical binder to weak carbon bonds of less than 5 pounds per square inch tensile strength.

5. A method of claim 4, wherein the oxidant materials initially contained within the impregnating liquid are ignited by the heat of a poured molten non-ferrous product metal.

6. A method of claim 5, wherein the oxidant materials used to impregnate the molds and cores are chemically oxidized at a controlled rate above 500° F. after the molten product metal has solidified in a mold cavity.

* * * * *